United States Patent [19]

Saito et al.

[11] Patent Number: 4,922,257

[45] Date of Patent: May 1, 1990

[54] CONFORMAL ARRAY ANTENNA

[75] Inventors: Jun Saito; Tetsuo Haruyama; Nobutake Orime; Takashi Katagi, all of Kanagawa, Japan

[73] Assignee: Mitsubishi Denki Kabushiki Kaisha, Tokyo, Japan

[21] Appl. No.: 147,721

[22] Filed: Jan. 25, 1988

[30] Foreign Application Priority Data

| | | | |
|---|---|---|---|
| Jan. 27, 1987 | [JP] | Japan | 62-10010[U] |
| Feb. 6, 1987 | [JP] | Japan | 62-25865 |
| Feb. 6, 1987 | [JP] | Japan | 62-25866 |

[51] Int. Cl.[5] ..... H01Q 3/00

[52] U.S. Cl. ..... 342/377; 342/368; 342/371; 342/374; 342/444

[58] Field of Search ..... 342/368, 371, 372, 374, 342/377, 444; 455/610

[56] References Cited

U.S. PATENT DOCUMENTS

| | | | |
|---|---|---|---|
| 4,212,084 | 7/1980 | Poole | 342/377 |
| 4,216,475 | 8/1980 | Johnson | 342/377 |
| 4,229,739 | 10/1980 | Smith | 342/377 |
| 4,274,148 | 6/1981 | van't Hullenaar | 342/377 |
| 4,546,249 | 10/1985 | Whitehouse et al. | 455/610 |
| 4,656,479 | 4/1987 | Kirimoto et al. . | |
| 4,739,334 | 4/1988 | Soref | 342/368 |

OTHER PUBLICATIONS

The Role of Digital Processing in Radar Beamforming, B. Wardrop GEC Journal of Research, V3, #1, 1985.

Opto Electronics-A New Dimension in Electronics, Davies, The Radio and Electronic Engineer, V54 #1, 1984.

Fiber Optic Communication Links for Millimeter Wave Phased Array Antennas, Contarino et al., Conference Record of the Milcom 1986.

Steverung and Formung von Strahlungsharakteristken mit Gruppenantennen, Borgman, Wissenschaftliche Berichte AEG Telefunken V54, #1/2, 1981.

Microprocessor Provides MultiMode Vesatility for ESSA Antenna System, Stockton et al., 1979 Int. Symp. Digest-Antennas & Propagation V2.

"GEC Journal of Research", vol. 3, No. 1, pp. 34–45 (1985).

*Primary Examiner*—Thomas H. Tarcza

*Assistant Examiner*—David Cain

*Attorney, Agent, or Firm*—Wolf, Greenfield & Sacks

[57] ABSTRACT

A conformal array antenna system is disclosed comprising a structural base body having a shape suitable for a surface of an airplane or a ship, and a plurality of antenna units disposed on the structural base body. Signals received by these antenna units are converted into digital signals and fed to a digital beam forming circuit which synthesizes such digital signals to form a multiplicity of beams. The antenna units and the digital beam forming circuits may be connected by electrical transmission lines or optical fibers.

23 Claims, 10 Drawing Sheets

CONFORMAL ARRAY ANTENNA

BACKGROUND OF THE INVENTION

1. Field of the Invention

The present invention relates to a conformal array antenna for use with a radar system.

2. Description of the Prior Art

FIG. 1 illustrates a block diagram of a prior art antenna system. In the figure, the reference numeral 1 designates a conformal array antenna including a structural base body 2 assuming a semi-spherical configuration and a number n of antenna units $3_1$ to $3_n$ arrayed on the structural base body 2. A number n of signal lines $4_1$ to $4_n$ interconnect the antenna units $3_1$ to $3_n$ and a microwave beam forming circuit 5. Each of the antenna units $3_1$ to $3_n$ which constitute the conformal array antenna 1 is an independent unitary antenna device.

Next, the operation of the prior art antenna system will be described. A microwave power is received by the antenna units $3_1$ to $3_n$ arrayed on the semi-spherical structural base body 2 of the conformal array antenna 1, and is transmitted via the signal lines $4_1$ to $4_n$ to the microwave beam forming circuit 5 where the microwave signals are synthesized to form a multiplicity of beams by making use of microwave phase shifters, microwave variable attenuators, microwave switches and microwave couplers.

In the thus constructed conventional antenna system, the antenna beams can be arbitrarily formed over the semisphere. In the case of forming a multiplicity of beams by employing microwave devices such as a phase shifter, an attenuator, a switch, a coupler and a distributor, however, the configuration loss becomes larger and only a limited number of beams can be formed concurrently. Supposing that a beam is oriented in a desired direction when used as a part of the radar system, the shadowed units among the antenna units $3_1$ to $3_n$ when viewing the conformal array antenna 1 from the desired direction cannot be effectively utilized. Especially when a scanning angle approximates to 90° from the zenith, almost half of the elements are not available for use.

SUMMARY OF THE INVENTION

A general object of the present invention is to eliminate the problems described above.

It is an object of the present invention to provide an antenna system capable of simultaneously synthesizing a plurality of beams and constantly utilizing all the antenna units in an effective manner.

In order to accomplish the above object, an antenna system according to the present invention comprises a plurality of antenna units each of which is adapted to convert outputs from an element antenna into a digital signal, and a digital beam forming circuit. The digital beam forming circuit effects a parallel process for synthesizing digital signals including phase and amplitude information supplied from the respective antenna units. It is, therefore, possible to concurrently synthesize the digital signals to form a multiplicity of beams, which permits effective utilization of all the antenna units. Additionally, the problems that are caused by cross polarization can be eliminated. Moreover, a considerable improvement in performance is provided with respect to multi-target processing, expansion of the antenna beam scanning range, interconnection with other signal processing systems based on digital processing, and miniaturization of the antenna system.

It is another object of the invention to provide an antenna system capable of simultaneously synthesizing digital signals to form a multiplicity of beams, utilizing all the antenna units effectively and reducing the electromagnetic interference between signal lines interconnecting the antenna units and a digital beam forming circuit.

In order to achieve this object, an antenna system according to the present invention comprises a plurality of antenna units each having photo-modulator means. The output from the photo-modulator means is sent by optical fibers to photo-demodulator means which convert the light signals to the corresponding electrical signals. These electrical signals are in a digital form and are supplied to a digital beam forming circuit. The digital beam forming circuit is capable of processing the digital signals including phase amplitude information by effecting a parallel process for synthesizing such digital signals. It is, therefore, possible to concurrently form a multiplicity of beams, which permits effective utilization of all the antenna units. Because the optical fibers are employed for transmission of the signals, the problem caused by the electromagnetic interference is greatly reduced.

It is still another object of the present invention to provide an antenna system capable of simultaneously synthesizing a multiplicity of beams, utilizing all the antenna units in an effective manner, and solving the problems that are caused by electromagnetic interference and cross polarization attributed to the difference in polarization between the antenna units.

In order to achieve this object, an antenna system of the present invention comprises a plurality of antenna units each including a transmitting section, a receiving section and a TR switch. The transmitting sections include a phase controller and are connected to a microwave power distributor, while the receiving sections include a low-noise amplifier and the received signals are converted to digital signals and fed to a digital beam forming circuit. The digital beam forming circuit serves to process the digital signals including phase-amplitude information for arbitrarily synthesizing these signals to form multiple beams simultaneously, and to enable all the antenna units to be utilized effectively. Moreover, because the transmitting section and the receiving section are incorporated to use the same element antenna, the problems caused by cross polarization are eliminated. If the signals are transmitted through optical fibers, a remarkable reduction in the electromagnetic interference can be expected and the signal transmission lines can be miniaturized.

Other features and advantages of the invention will be apparent from the following description taken in connection with the accompanying drawings.

DESCRIPTION OF THE PREFERRED EMBODIMENTS

Figure 1:
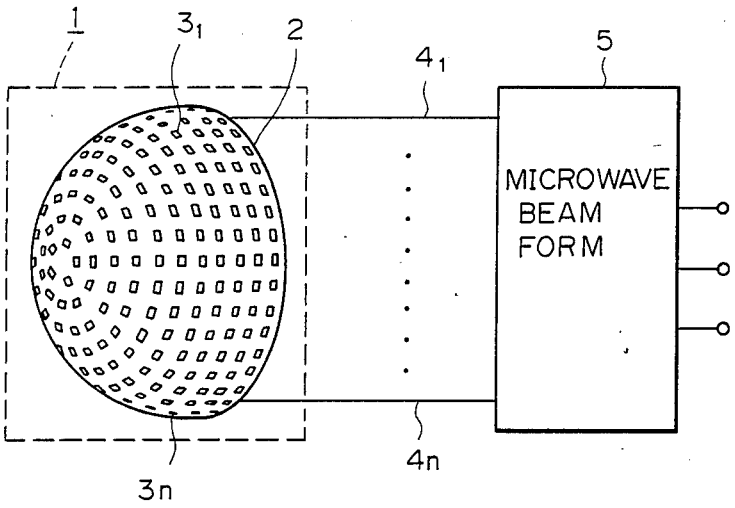
Fig. 1 ( PRIOR ART )
FIG. 1 is a schematic illustration of a conventional conformal array antenna system.
Figure 2:
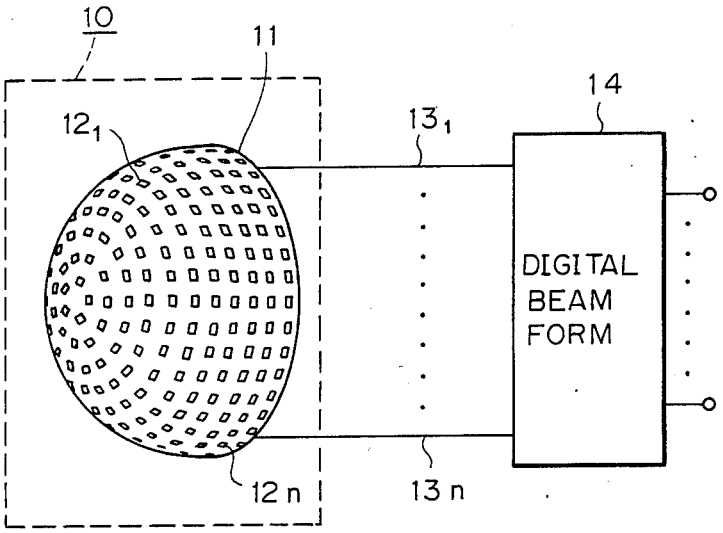
FIG. 2 is a block diagram of a first embodiment of a conformal array antenna system according to the present invention.

FIG. 2 shows the first embodiment of the present invention which is embodied as a receiving antenna system or a passive detection antenna system for use with a separate transmitting antenna system.

Figure 3:
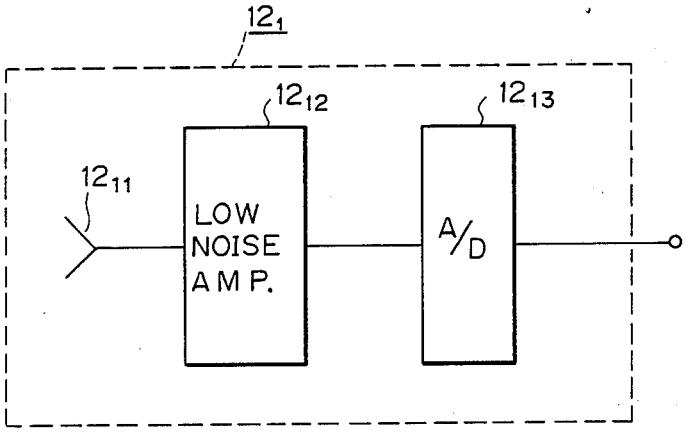
FIG. 3 is a block diagram of an antenna unit of the conformal array antenna system shown in FIG. 2.

In FIG. 2, a conformal array antenna 10 includes a structural base body 11 which assumes a semi-spherical configuration and a number n of antenna units $\mathbf{12}_1$ to $\mathbf{12}_n$ arrayed on the structural base body 11. A number n of signal lines $\mathbf{13}_1$ to $\mathbf{13}_n$ interconnect the antenna units $\mathbf{12}_1$ to $\mathbf{12}_n$ and a digital beam forming circuit 14. The antenna units $\mathbf{12}_1$ to $\mathbf{12}_n$ have the same structure. FIG. 3 shows a schematic diagram of the antenna unit $\mathbf{12}_1$ as an example. The antenna unit $\mathbf{12}_1$ comprises an element antenna $\mathbf{12}_{11}$, a low-noise amplifier $\mathbf{12}_{12}$ and an A/D converter $\mathbf{12}_{13}$.

Next, the operation of the antenna system will be explained with reference to FIGS. 2 and 3. Microwave signals are received by the element antennas $\mathbf{12}_{11}$ to $\mathbf{12}_{n1}$ of the antenna units $\mathbf{12}_1$ to $\mathbf{12}_n$ which are fixed to the structural base body 11 of the conformal array antenna 10. The received microwave signals are then amplified by the low-noise amplifiers $\mathbf{12}_{12}$ to $\mathbf{12}_{n2}$, the outputs of which are, directly or after being converted into the IF signals, supplied to A/D converters $\mathbf{12}_{13}$ to $\mathbf{12}_{n3}$ which convert the supplied microwave signals to digital signals including phase and amplitude information. The digital signals are transmitted via the signal lines $\mathbf{13}_1$ to $\mathbf{13}_n$ to the digital beam forming circuit 14, in which the signals are synthesized as the digital signals to form multiple-beams by employing known techniques such as discrete Fourier transformation, fast Fourier transformation and Winograd Fourier transformation. Hence, it is feasible to digitally effect a parallel process of a plurality of signals transmitted from the antenna units $\mathbf{12}_1$ to $\mathbf{12}_n$ in accordance with arbitrary beam configurations. Pieces of information sent from all the antenna units $\mathbf{12}_1$ to $\mathbf{12}_n$ can be processed at any time in an effective manner, thereby enabling the information arriving from all directions in the semi-sphere to be obtained.

Generally speaking, the amplitudes and phases at the antenna aperture of each of the antenna units $\mathbf{12}_1$ to $\mathbf{12}_n$ are different from each other in correspondence with the position of the antenna units and the direction of the incoming waves. Accordingly, the signal $e_i$ received by the element antenna $\mathbf{12}_{i1}$ of the antenna unit $\mathbf{12}_i$ is expressed as follows:

$$e_i = g_i e^{j\phi_i}$$

$$i = 1, 2, \ldots, n$$

wherein $g_i$ is an element pattern of the element antenna $\mathbf{12}_{i1}$ and is a complex amount that depends on the position of the element antenna, and $\phi_i$ represents an electrical length which is equivalent to the difference between the mutual distances of the respective element antenna, the received signal $e_i$ thus being a complex number.

Figure 4:
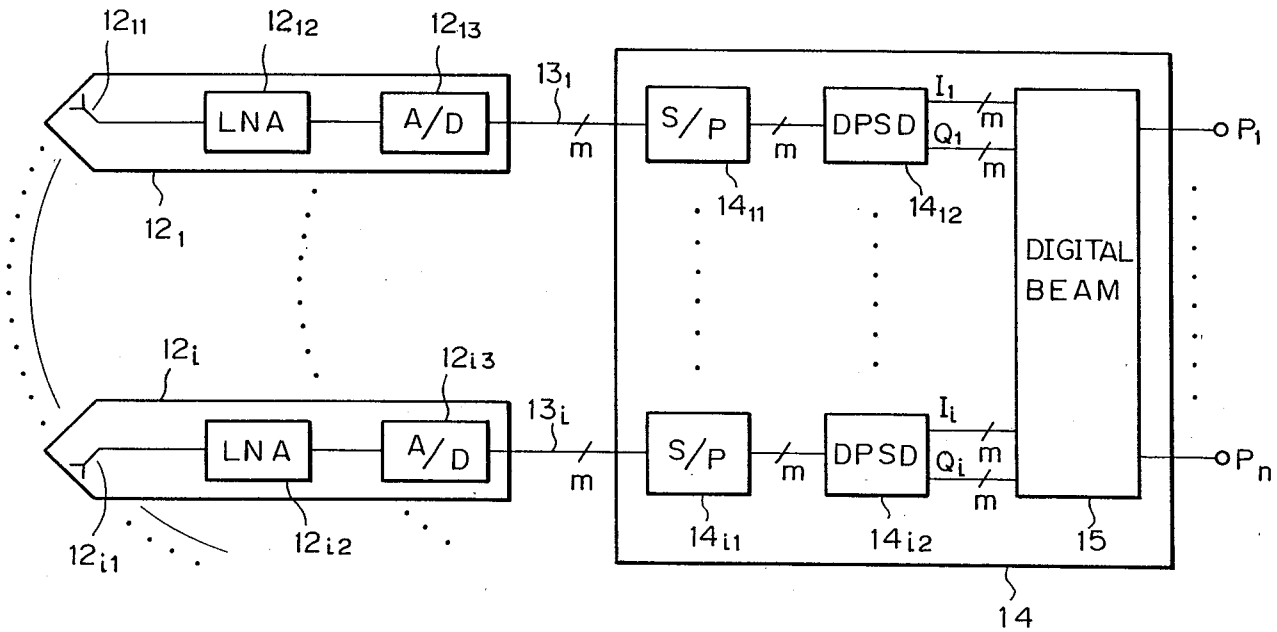
FIG. 4 shows in detail the structure of the conformal array antenna system shown in FIG. 2.

Referring now to FIG. 4, there is shown in schematic form the structure of the conformal array antenna system as shown in FIG. 2. As shown in FIG. 4, the digital beam forming circuit 14 includes a number n of serial-to-parallel converters $\mathbf{14}_{11}$ to $\mathbf{14}_{n1}$ connected respectively to the signal lines $\mathbf{13}_1$ to $\mathbf{13}_n$, a number n of digital phase sensitive detectors $\mathbf{14}_{12}$, to $\mathbf{14}_{n2}$ connected to the corresponding serial-to-parallel converters, and a digital beam forming unit 15 for producing a plurality of output signals at output port $P_1$ to $P_n$. The signal lines $\mathbf{13}_1$ to $\mathbf{13}_n$ carry m-bit digital signals from the analogue-to-digital converters $\mathbf{12}_{13}$ to $\mathbf{12}_{n3}$ to the serial-to-parallel converters $\mathbf{14}_{11}$ to $\mathbf{14}_{n1}$.

An explanation will be made by giving instances of the procedure of processing the microwave signal impinging on the antenna unit $\mathbf{12}_i$.

The microwave reflected by a target and received by the element antenna $\mathbf{12}_i$ is an analogue signal. The analogue signal thus received is in turn amplified by the low-noise amplifier $\mathbf{12}_{i2}$, with the relative relationship between the amplitude and the phase maintained. The amplified signal is fed to the analogue-to-digital converter $\mathbf{12}_{i3}$ in which the signal is sampled and quantized to form an m-bit digital signal. The m-bit signal is transmitted through the signal line $\mathbf{13}_i$ to the serial-to-parallel converter $\mathbf{14}_{i1}$ in the digital beam forming circuit 14.

In the digital beam forming circuit, the m-bit serial signal from the line $\mathbf{13}_i$ is converted to an m-bit parallel signal by the serial-to-parallel converter $\mathbf{14}_{i1}$. The parallel signal is sent every sampling time to the digital phase sensitive detector (DPSD) $\mathbf{14}_{i2}$, which converts the input signal to an I-signal and a Q-signal having the following relation:

$$e_i = I_i + jQ_i$$

Figure 5:
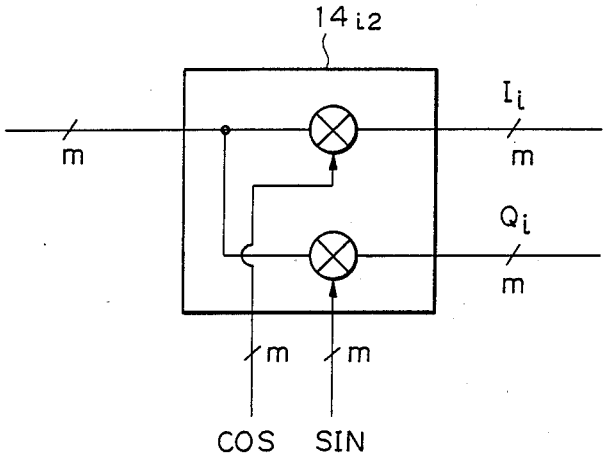
FIG. 5 is a schematic diagram of the DPSD shown in FIG. 4.

FIG. 5 shows an example of the DPSD. The input signal to the DPSD $\mathbf{14}_{i2}$, is divided into two portions which are multiplied by the sine and cosine waves, respectively, to output two separate signals $I_i$ and $Q_i$ which are to be supplied to the digital beam forming unit 15. Similar to this, the signals received by the remaining antenna units are processed and sent to the digital beam forming unit 15. The digital beam forming unit is well-known as a discrete Fourier transform (DFT) beamformer, a fast Fourier transform (FFT) beamformer or a Winograd transform beamformer. Accordingly, the output signals corresponding respectively with n directions $\theta_1$ to $\theta_n$ are obtained from the output port $P_1$ to $P_n$. For example, the output signal $E_i$ at the port $P_i$ is expressed as follows:

$$E_i = I_i + jQ_i$$

$$|E_i| = (I_i^2 + Q_i^2)^{\frac{1}{2}}$$

$$< E_i = \tan^{-1}(Q_i/I_i)$$

Figure 7:
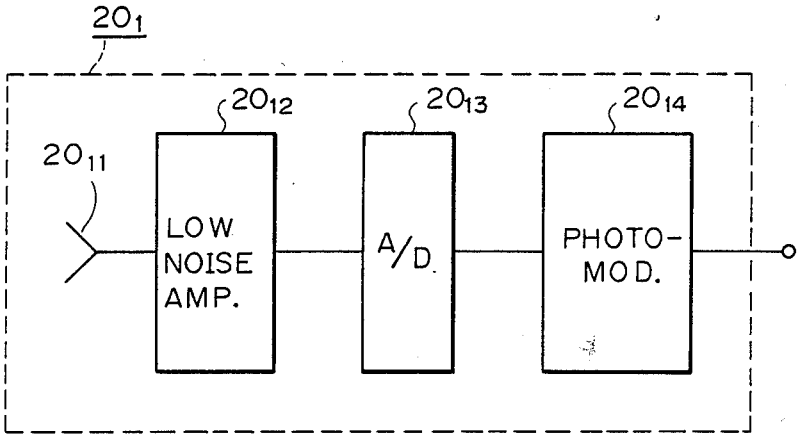
FIG. 7 is a block diagram of an antenna unit of the conformal array antenna system shown in FIG. 6.
Figure 6:
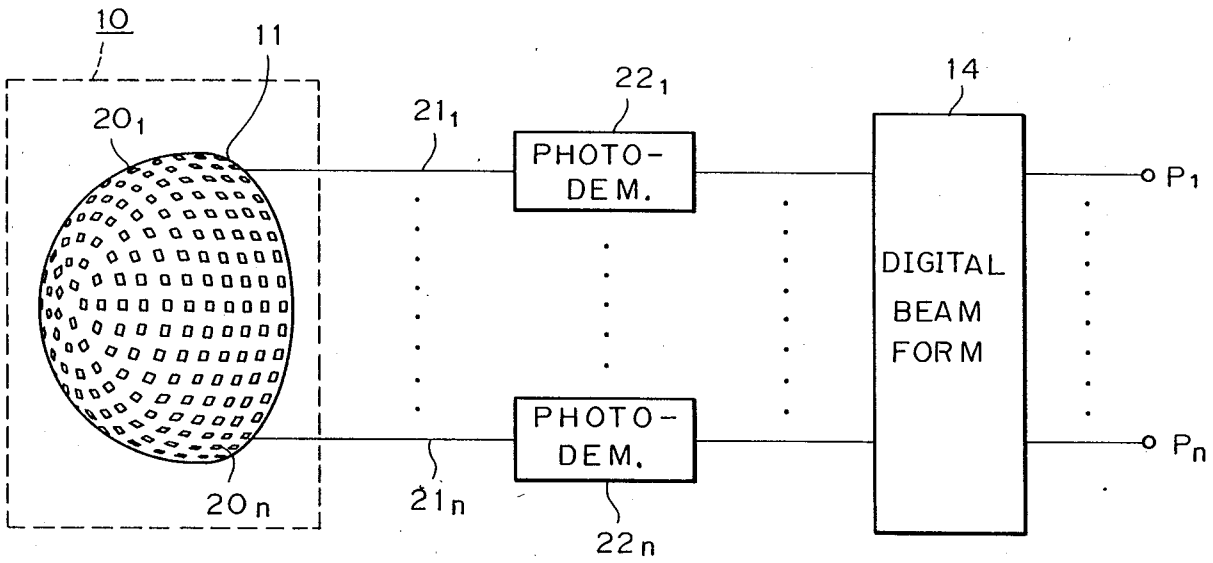
FIG. 6 is a block diagram of a second embodiment of a conformal array antenna system according to the present invention.

Turning now to FIG. 6, the second embodiment of the present invention is shown. In FIG. 6, identical components and elements are designated by the same numerals as those used in FIGS. 2 through 5. A number n of antenna units $20_1$ to $20_n$ arrayed on the structural base body 11 are connected through optical fibers $21_1$ to $21_n$ to a number n of photo-demodulators $22_1$ to $22_n$ which are, for example, photoelectric converters. The outputs from the photodemodulators are fed to the digital beam forming circuit 14 for synthesis. The antenna units $20_1$ to $20_n$ are of the same structure. FIG. 7 shows a block diagram of the antenna unit $20_1$ as an example. As shown in the figure, the antenna unit $20_1$ comprises an element antenna $20_{11}$, a low-noise amplifier $20_{12}$, connected to the element antenna $20_{11}$, an analogue-to-digital converter $20_{13}$, connected to the low-noise amplifier $20_{12}$ and a photo-modulator $20_{14}$ connected to the analogue-to-digital converter $20_{13}$. The photo-modulator may be a conventional electro-photo converter.

Next, the operation of the antenna system will be described. Microwave signals are received by the element antennas $20_{11}$ to $20_{n1}$ of the antenna units $20_1$ to $2O_n$ and then amplified by the low-noise amplifiers $20_{12}$ to $20_{n2}$. The thus amplified microwave signals are, directly or after being converted into the IF signals, supplied to the A/D converters $20_{13}$, to $20_{n3}$ to be converted to digital signals including the phase and amplitude information. The digital signals are then converted into photo-signals by the photomodulators $20_{14}$ to $20_{n4}$ and transmitted via the optical fibers $21_1$ to $21_n$ to the photo-demodulators $22_1$ to $22_n$. The digital electric signals thus demodulated by the photodemodulators $22_1$ to $22_n$ are supplied to the digital beam forming circuit 14 which synthesizes the digital signals by employing known techniques such as discrete Fourier transformation, fast Fourier transformation and Winograd Fourier transformation. Also in the second embodiment, it is feasible to digitally effect a parallel process of a plurality of the signals received by the antenna units $20_1$ to $20_n$ according to arbitrary antenna beam configurations. Pieces of information received by the antenna units $21_1$ to $21_n$ can be processed in an effective manner, thereby obtaining the information from all directions in the semi-sphere. Because the optical fibers are used as transmission lines, no problem of electromagnetic interference can happen. Also, the signal lines can be miniaturized.

Figure 8:
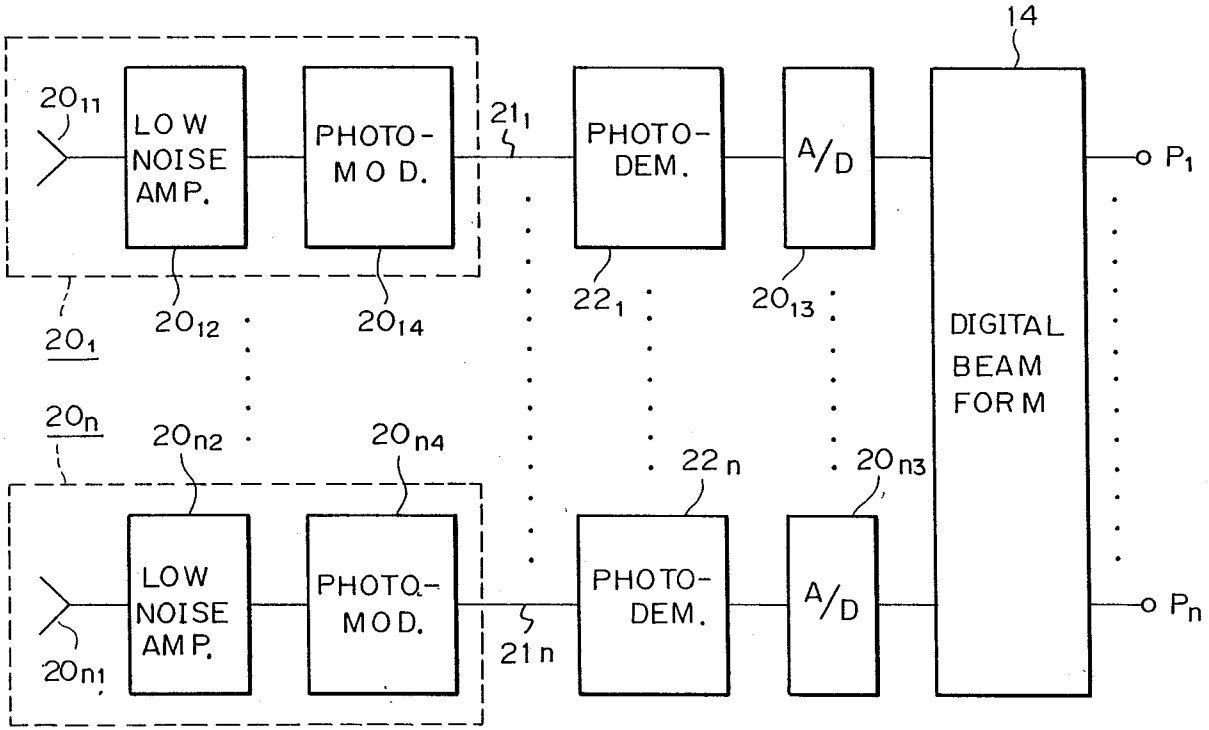
FIG. 8 is a modified form of the second embodiment.

The A/D converters $20_{13}$ to $20_{n3}$ are inserted between the low-noise amplifiers and the photo-modulators in FIG. 7, but each A/D converter may, as illustrated in FIG. 8, be disposed between the photo-demodulator and the digital beam forming circuit. In this case, the photo-modulators $20_{14}$ to $20_{n4}$ convert the microwave signals, directly or after being converted into the IF signals, into the photo-signals. The thus converted photo-signals are transmitted via the optical fibers $21_1$ to $21_n$ to the photo-demodulators $22_1$ to $22_n$ to be demodulated to the electrical signals. The demodulated electrical signals are converted, directly or after being converted into the IF signals, into the digital signals by means of the A/D converters $20_{13}$ to $20_{n3}$.

The two embodiments described above relate to receiving antenna systems. On the other hand, the third and fourth embodiments shown in FIGS. 9 through 12 are systems capable of transmitting and receiving microwave signals. In these figures, identical elements and components are designated by the same reference numerals as those used in FIGS. 1 through 8.

Figure 9:
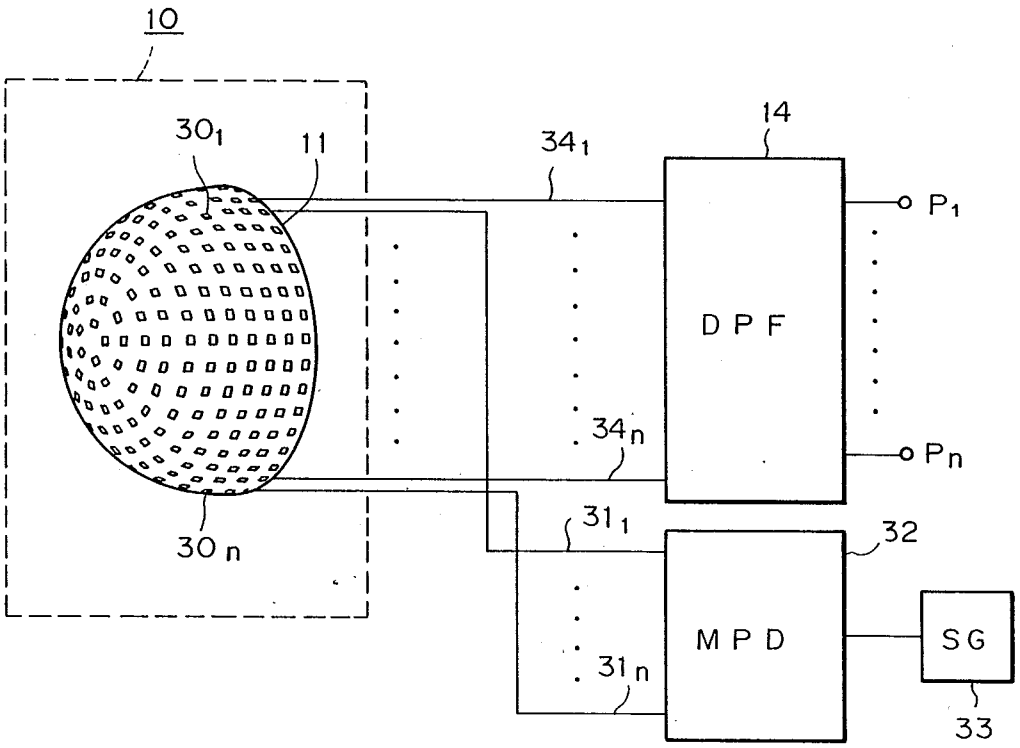
FIG. 9 is a block diagram of a third embodiment of a conformal array antenna system according to the present invention.

Referring now to FIG. 9, a number n of antenna units $30_1$ to $30_n$ arranged on the semi-spherical body 11 of the conformal array antenna 10 are connected through a number n of sending lines $31_1$ to $31_n$ to a microwave power distributor 32 that is receiving microwave power from a transmitting signal generator 33. The antenna units $30_1$ to $30_n$ are also connected through a number n of receiving lines $34_1$ to $34_n$ to the digital beam forming circuit 14 which synthesizes input digital signals to form a multiplicity of beams.

Figure 10:
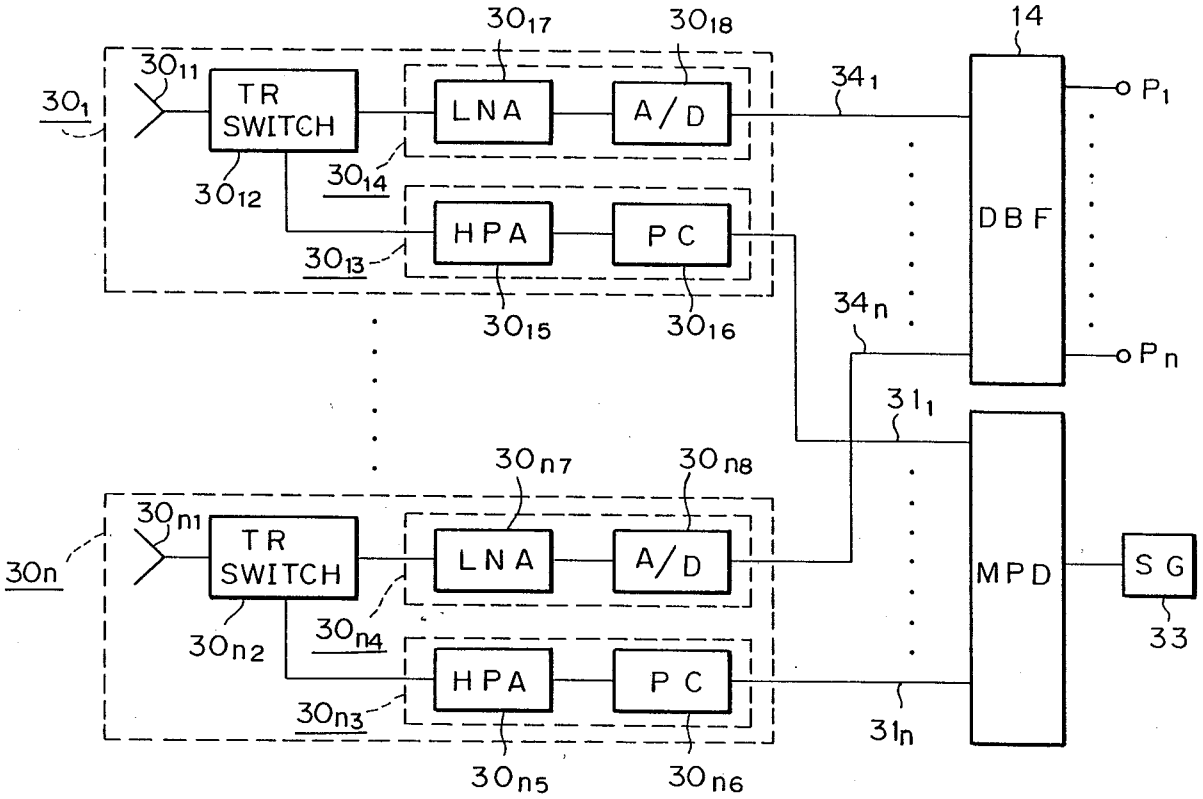
FIG. 10 shows the structure of the antenna unit shown in FIG. 9.

FIG. 10 is a more detailed illustration of the conformal array antenna system shown in FIG. 9. As seen in FIG. 10, all the antenna units $30_1$ to $30_n$ have the same circuit structures. Element antennas $30_{11}$ to $30_{n1}$ are connected through TR switches $30_{12}$, to $30_{n2}$ to transmitting sections $30_{13}$ to $30_{n3}$ and to receiving sections $30_{14}$ to $30_{n4}$. These TR switches $30_{12}$ to $30_{n2}$, may be conventional circulators or diode switches. The transmitting sections $30_{13}$ to $30_{n3}$ include high power amplifiers $30_{15}$ to $30_{n5}$ and phase controllers $30_{16}$ to $30_{n6}$, while the receiving sections $30_{14}$ to $30_{n4}$ include low-noise amplifiers $30_{17}$ to $30_{n7}$, and analogue-to-digital converters $30_{18}$ to $30_{n8}$.

Next, the operation of the antenna system of FIG. 10 will be explained. A microwave signal received from the signal generator 33 and input to the microwave power distributor 32 is distributed to a number n of outputs each having a desired amplitude and phase. These output signals are transmitted via the sending lines $31_1$ to $31_n$ to the transmitting sections $31_{13}$ to $31_{n3}$ of the antenna units $30_1$ to $30_n$. In the transmitting sections, the microwave signals undergo phase changes in the phase controllers $30_{16}$ to $30_{n6}$ so as to form desired antenna beams. Then the phase-controlled microwave signals are amplified by the high power amplifiers $30_{15}$ to $30_{n5}$, pass through the TR switches $30_{12}$ to $30_n$, and are then emitted from the element antennas $30_{11}$ to $30_{n1}$ into space. The microwave signals which have been emitted into space are reflected by a target and received by the element antennas $30_{11}$ to $30_{n1}$. Subsequently, the received microwave signals are transmitted via the TR switches $30_{12}$ to $30_{n2}$ to the receiving sections $30_{14}$ to $30_{n4}$ of the antenna units. The microwave signals input to the receiving sections $30_{14}$ to $30_{n4}$ are amplified by the low-noise amplifiers $30_{17}$ to $30_{n7}$. The thus amplified microwave signals are fed, directly or after being converted into the IF signals, to the analogue-to-digital converters $30_{18}$ to $30_{n8}$ which in turn convert the input analogue signals into digital signals including phase and amplitude information. These digital signals are transmitted via the receiving lines $34_1$ to $34_n$ to the digital beam forming circuit 14 in which the signals are synthesized to form multiple beams by employing known techniques such as discrete Fourier transformation, fast Fourier transformation and Winograd Fourier transformation. Hence, it is possible to digitally effect a parallel process of the signals sent from the antenna units $30_1$ to $30_n$ in accordance with arbitrary beam configurations. Furthermore, the information from all the antenna units can be processed unfailingly in an effective manner, thereby constantly obtaining information from all directions in the semi-sphere.

When antenna units $30_1$ to $30_{n1}$ which are adapted for a linearly polarized wave are employed, the polarization of the transmitted signal is the same as that of the signal received after being reflected by the target, if consideration is given to the individual element antennas $30_{11}$ to $30_{n1}$. The signals reflected by and coming from the target are converted into digital signals including phase-amplitude information, and the digital signals are synthesized by the digital beam forming circuit 14, so the problem of cross polarization caused by the difference in polarization between the antenna units is solved.

Figure 11:
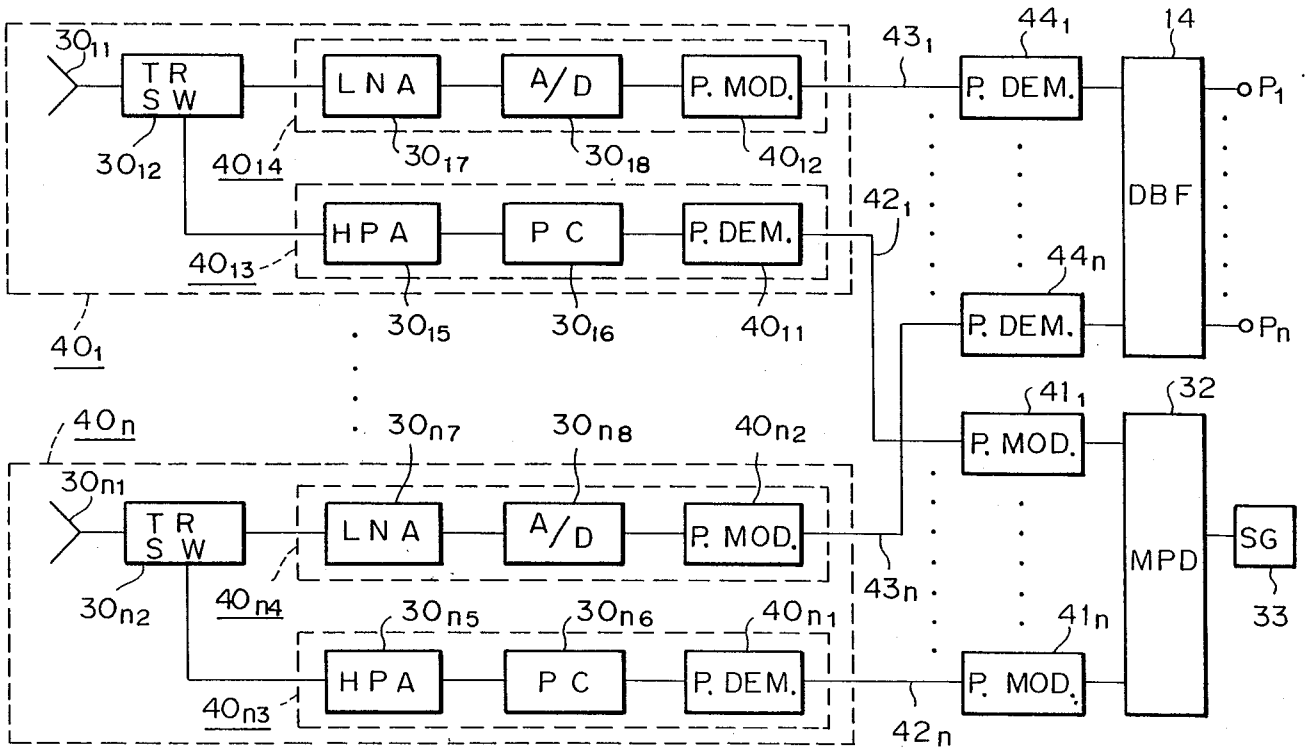
FIG. 11 is a block diagram of a fourth embodiment of a conformal array antenna system according to the present invention.

The same operation as the third embodiment may be expected even when light signals are utilized for transmission of signals between the antenna units $\mathbf{31}_1$ to $\mathbf{31}_n$ and the microwave power distributing circuit 32 and the digital beam forming circuit 14. FIG. 11 shows the fourth embodiment of the present invention which uses light signals for transmission of signals. In comparison with the third embodiment, the antenna units $\mathbf{40}_1$ to $\mathbf{40}_n$ of the fourth embodiment include photo-modulators $\mathbf{40}_{12}$ to $\mathbf{40}_{n2}$ and photo-demodulators $\mathbf{40}_{11}$ to $\mathbf{40}_{n1}$. The outputs from the microwave distributing circuit S2 are converted into light signals by the photomodulators $\mathbf{41}_1$ to $\mathbf{41}_n$ and are then transmitted via optical fibers $\mathbf{42}_1$ to $\mathbf{42}_n$ to photo-demodulators $\mathbf{40}_{11}$ to $\mathbf{40}_{n1}$ added the transmitting section $\mathbf{40}_{13}$ to $\mathbf{4O}_{n3}$ of the antenna units. In the photo-demodulators, the light signal are converted into microwave signals to be transmitted. In reception, the digital signals are converted into light signals by means of the photo-modulators $\mathbf{40}_{12}$ to $\mathbf{40}_{n2}$ added to the receiving section $\mathbf{40}_{14}$ to $\mathbf{40}_{n4}$ of the antenna units. The thus converted light signals are transmitted via optical fibers $\mathbf{43}_1$ to $\mathbf{43}_n$ to photo-demodulators $\mathbf{44}_1$ to $\mathbf{44}_n$ to provide electrical signals to the digital beam forming circuit 14. In the fourth embodiment shown in FIG. 11, the light signals are employed for the transmission of signals between the devices and hence the problem caused by electromagnetic interference between the signal lines is obviated, and the signal lines are of diminished size by virtue of the provision of the optical fibers.

Figure 12:
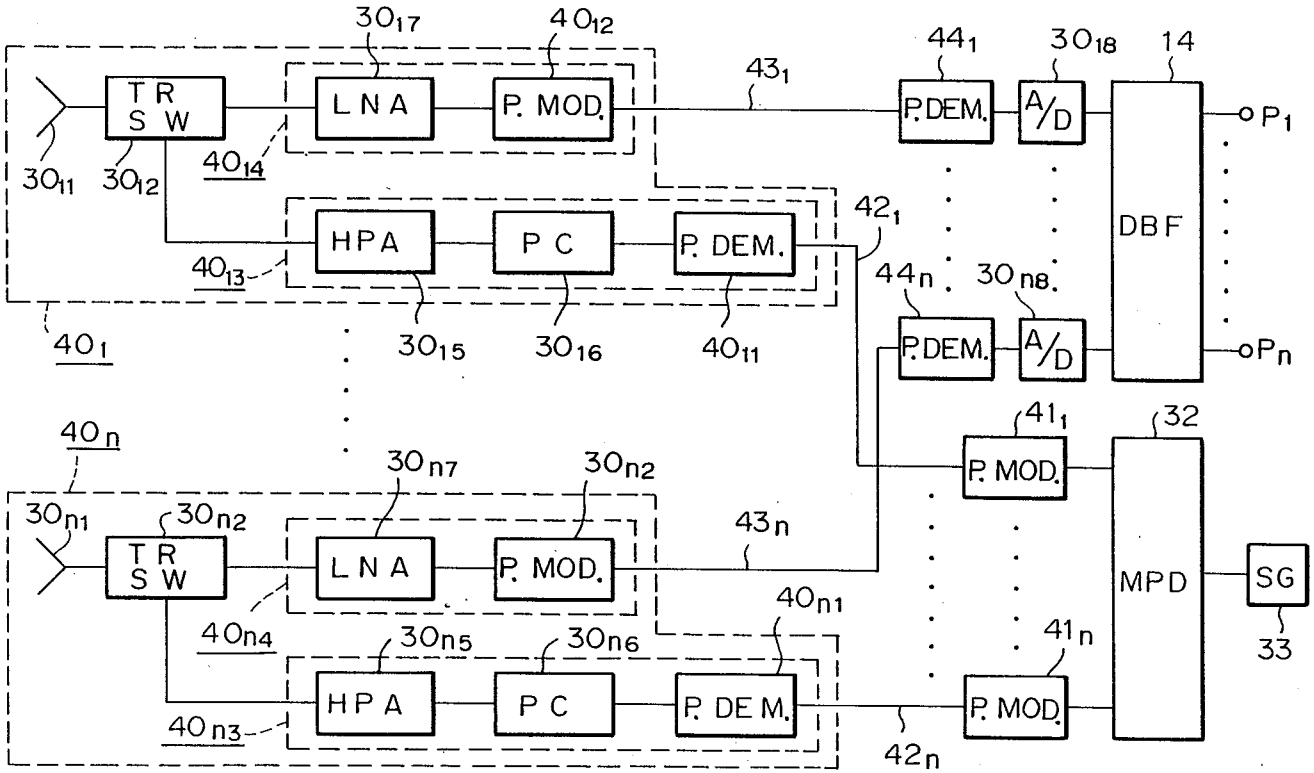
FIG. 12 is a modified form of the fourth embodiment.

FIG. 12 is a modification of the fourth embodiment shown in FIG. 11. In this case, the analogue-to-digital converters $\mathbf{30}_{18}$ to $\mathbf{30}_{n8}$ of the receiving sections are positioned between the photo-demodulators $\mathbf{44}_1$ to $\mathbf{44}_n$ and the digital beam forming circuit 14. It can be expected that operation and effects similar to those achieved in the fourth embodiment will be exhibited.

The invention has been described in detail with particular reference to certain preferred embodiments thereof, but it will be understood that variations and modifications can be effected within the spirit and scope of the invention. For example, the shape of the conformal array antenna system according to the present invention is need not be limited to the semi-sphere, but may be made to be fitted to the shape of certain structures such as ships, airplanes, missiles, vehicles, satellites and ground radar sites, or may be a portion of a cylinder, sphere or cone, or a portion or portions of a shape made as a combination of any two or three of a cylinder, a sphere and a cone. Further, the conformal array antenna system of the present invention can utilize not only linearly polarized waves but also circularly polarized waves.

We claim:

1. A conformal array antenna system comprising:

a plurality of element antennas disposed on a three-dimensional surface of a structural body;

a plurality of analog-to-digital conversion means, each operable to receive an analog electrical signal from a corresponding one of said element antennas to convert the received analog electrical signal to a digital electrical signal of a serial form;

a plurality of serial-to-parallel conversion means, each operable to receive the digital electrical signal from a corresponding one of said analog-to-digital conversion means to convert the received digital electrical signal to a parallel digital electrical signal;

a plurality of phase detection means, each operable to receive the parallel electrical signal from a corresponding one of said serial-to-parallel conversion means to convert the received parallel electrical signal to real and imaginary components thereof; and digital beam forming means operable to receive the real and imaginary components from said phase detection means to synthesize these real and imaginary components so as to form a multiplicity of beams.

2. An antenna system as defined in claim 1 wherein the outputs of said analog-to-digital conversion means are respectively connected through transmission lines to the inputs of said serial-to-parallel conversion means.

3. An antenna system as defined in claim 2 wherein each of said analog-to-digital conversion means includes a low-noise amplifier for amplifying the analog electrical signal and an analog-to-digital converter for converting the amplified analog electrical signal to the digital electrical signal.

4. In a conformal array antenna system comprising a plurality of element antennas disposed on a surface of a predetermined shape, the improvement characterized in that said plurality of element antennas are dispersed on a three-dimensional surface of a structural base body, and characterized by the combination of:

a plurality of analog-to-digital conversion means, each operable to receive an analog electrical signal from a corresponding one of said element antennas to convert the received analog electrical signal to a digital electrical signal of a serial form;

a plurality of serial-to-parallel conversion means, each operable to receive the digital electrical signal from a corresponding one of said analog-to-digital conversion means to convert the received digital electrical signal to a parallel electrical signal;

a plurality of phase detection means, each operable to receive the parallel electrical signal from a corresponding one of said serial-to-parallel conversion means to convert the received parallel electrical signal to real and imaginary components thereof; and digital beam forming means operable to receive the real and imaginary components from said phase detection means to synthesize the real and imaginary components so as to form a multiplicity of beams.

5. An antenna system as defined in claim 4 wherein the outputs of said analog-to-digital conversion means are respectively connected through transmission lines to the inputs of said serial-to-parallel conversion means.

6. An antenna system as defined in claim 5 wherein each of said analog-to-digital conversion means includes a low-noise amplifier for amplifying the analog electrical signal and an analog-to-digital converter for converting the amplified analog electrical signal to the digital electrical signal.

7. A conformal array antenna system comprising:

a plurality of element antennas disposed on a three-dimensional surface of a structural body;

a plurality of analog-to-digital conversion means, each operable to receive an analog electrical signal from a corresponding one of said element antennas to convert the received analog electrical signal to a digital electrical signal of a serial form;

a plurality of photo-modulation means, each operable to receive the digital electrical signal from a corresponding one of said analog-to-digital conversion means to convert the received digital electrical signal to a digital light signal;

a plurality of optical fiber means, each operable to transmit the digital light signal from a corresponding one of said photo-modulation means;

a plurality of photo-demodulation means operable to receive the digital light signal from a corresponding one of said optical fiber means to convert the received digital light signal to a digital electrical signal;

a plurality of serial-to-parallel conversion means, each operable to receive the digital electrical signal from a corresponding one of said photo-modulation means to convert the received digital electrical signal to a parallel electrical signal;

a plurality of phase detection means, each operable to receive the parallel electrical signal from a corresponding one of said serial-to-parallel conversion means to convert the received parallel electrical signal to real and imaginary components thereof; and digital beam forming means operable to receive the real and imaginary components from said phase detection means to synthesize these real and imaginary components so as to form a multiplicity of beams.

8. An antenna system as defined in claim 7 wherein each of said analog-to-digital conversion means includes a low-noise amplifier for amplifying the analog electrical signal and an analog-to-digital converter for converting the amplified analog electrical signal to the digital electrical signal.

9. A conformal array antenna system comprising:

a plurality of element antennas disposed on a three-dimensional surface of a structural body;

a plurality of photo-modulation means, each operable to receive an analog electrical signal from a corresponding one of said element antennas to convert the received analog electrical signal to an analog light signal;

a plurality of optical fiber means, each operable to transmit the analog light signal from a corresponding one of said photo-modulation means;

a plurality of photo-demodulation means operable to receive the analog light signal from a corresponding one of said optical fiber means to convert the received analog light signal to an analog electrical signal;

a plurality of analog-to-digital conversion means, each operable to receive an analog electrical signal from a corresponding one of said photo-demodulation means to convert the received analog electrical signal to a digital electrical signal of a serial form;

a plurality of serial-to-parallel conversion means, each operable to receive the digital electrical signal from a corresponding one of said analog-to-digital conversion means to convert the received digital electrical signal to a parallel digital electrical signal;

a plurality of phase detection means, each operable to receive the parallel digital electrical signal from a corresponding one of said serial-to-parallel conversion means to convert the received parallel digital electrical signal to real and imaginary components thereof; and digital beam forming means operable to receive the real and imaginary components from said phase detection means to synthesize these real and imaginary components so as to form a multiplicity of beams.

10. An antenna system as defined in claim 9 wherein each of said analog-to-digital conversion means includes a low-noise amplifier for amplifying the analog electrical signal and an analog-to-digital converter for converting the amplified analog electrical signal to the digital electrical signal.

11. A conformal array antenna system comprising:

a plurality of element antennas disposed on a three-dimensional surface of a structural body;

transmitting signal generating means;

a plurality of signal transmitting means, each operable to receive the transmission signal to supply an electrical signal to a corresponding one of said element antennas at the time of transmission;

a plurality of analog-to-digital conversion means, each operable to receive an analog electrical signal from a corresponding one of said element antennas at the time of reception to convert the received analog electrical signal to a digital electrical signal of a serial form;

a plurality of serial-to-parallel conversion means, each operable to receive the digital electrical signal from a corresponding one of said analog-to-digital conversion means to convert the received digital electrical signal to a parallel electrical signal;

a plurality of phase detection means, operable to receive the parallel electrical signal from a corresponding one of said serial-to-parallel conversion means to convert the received parallel electrical signal to real and imaginary components thereof; and digital beam forming means operable to receive the real and imaginary components from said phase detection means to synthesize these real and imaginary components so as to form a multiplicity of beams.

12. An antenna system as defined in claim 11 further comprising switching means for correspondingly connecting said plurality of signal transmitting means to said plurality of element antennas at the time of transmission and correspondingly connecting said plurality of element antennas to said plurality of analog-to-digital conversion means at the time of reception.

13. An antenna system as defined in claim 12 wherein said plurality of signal transmitting means are coupled via transmission lines to said transmission signal generating means, and wherein said plurality of analog-to-digital conversion means are respectively connected via transmission lines to said plurality of serial-to-parallel conversion means.

14. An antenna system as defined in claim 13 wherein said plurality of signal transmitting means includes phasing means for controlling the phase of the electrical signal to be supplied to a corresponding one of said element antennas, thereby allowing an antenna beam to be formed in a desired direction.

15. An antenna system as defined in claim 14 wherein each of said analog-to-digital conversion means includes a low-noise amplifier for amplifying the analog electrical signal and an analog-to-digital converter for converting the amplified analog electrical signal to the digital electrical signal.

16. A conformal array antenna system comprising:

A plurality of element antennas disposed on a three-dimensional surface of a structural body;

transmission signal generating means;

a plurality of first photo-modulation means, each operable to receive the transmission signal to convert the received transmission signal to a light signal;

a plurality of first optical fiber means, each operable to transmit the light signal from a corresponding one of said first photo-modulation means;

a plurality of signal transmitting means, each operable to receive the light signal from a corresponding one of said first optical fiber means to convert the received light signal to an analog electrical signal so as to supply the converted analog electrical signal to a corresponding one of said element antennas at the time of transmission;

a plurality of analog-to-digital conversion means, each operable to receive an analog electrical signal from a corresponding one of said element antennas to convert the received analog electrical signal to a digital electrical signal of a serial form;

a plurality of second photo-modulation means, each operable to receive the digital electrical signal from a corresponding one of said analog-to-digital conversion means to convert the received digital electrical signal to a digital light signal;

a plurality of second optical fiber means, each operable to transmit the digital light signal from a corresponding one of said second photo-modulation means;

a plurality of photo-demodulation means, each operable to receive the digital light signal from a corresponding one of said second optical fiber means to convert the received digital light signal to a digital electrical signal;

a plurality of serial-to-parallel conversion means, each operable to receive the digital electrical signal from a corresponding one of said photo-demodulation means to convert the received digital electrical signal to a parallel electrical signal;

a plurality of phase detection means, each operable to receive the parallel electrical signal from a corresponding one of said serial-to-parallel conversion means to convert the received parallel electrical signal to real and imaginary components thereof; and digital beam forming means operable to receive the real and imaginary components from said phase detection means to synthesize these real and imaginary components so as to form a multiplicity of beams.

17. An antenna system as defined in claim 16 further comprising switching means for correspondingly connecting said plurality of signal transmitting means to said plurality of element antennas at the time of transmission and correspondingly connecting said plurality of element antennas to said plurality of analog-to-digital conversion means at the time of reception.

18. An antenna system as defined in claim 17 wherein each of said plurality of signal transmitting means includes a photo-demodulator operable to receive the light signal from a corresponding one of said first optical fiber means to convert the received light signal to the analog electrical signal and phasing means for controlling the phase of the analog electrical signal to be supplied to a corresponding one of said element antennas, thereby allowing an antenna beam to be formed in a desired direction.

19. An antenna system as defined in claim 18 wherein each of said analog-to-digital conversion means includes a low-noise amplifier for amplifying the analog electrical signal and an analog-to-digital converter for converting the amplified analog electrical signal to the digital electrical signal.

20. A conformal array antenna system comprising:

a plurality of element antennas disposed on a three-dimensional surface of a structural body;

transmission signal generating means;

a plurality of first photo-modulation means, each operable to receive the transmission signal to convert the received transmission signal to a light signal;

a plurality of first optical fiber means, each operable to transmit the light signal from a corresponding one of said first photo-modulation means;

a plurality of signal transmitting means, each operable to receive the light signal from a corresponding one of said first optical fiber means to convert the received light signal to an analog electrical signal so as to supply the converted analog electrical signal to a corresponding one of said element antennas at the time of transmission;

a plurality of second photo-modulation means, each operable to receive an analog electrical signal from a corresponding one of said element antennas to convert the received analog electrical signal to an analog light signal;

a plurality of second optical fiber means, each operable to transmit the analog light signal from a corresponding one of said second photo-modulation means;

a plurality of photo-demodulation means, each operable to receive the analog light signal from a corresponding one of said second optical fiber means to convert the received analog light signal from a corresponding one of said second photo-modulation means;

a plurality of photodemodulation means, each operable to receive the analog light signal from a corresponding one of said second optical fiber means to convert the received analog light signal to an analog electrical signal;

a plurality of analog-to-digital conversion means, each operable to receive the analog electrical signal from a corresponding one of said photodemodulation means to convert the received analog electrical signal to a digital electrical signal of a serial form;

a plurality of serial-to-parallel conversion means, each operable to receive the digital electrical signal from a corresponding one of said analog-to-digital conversion means to convert the received digital electrical signal to a parallel electrical signal from a corresponding one of said serial-to-parallel conversion means to convert the received parallel electrical signal to real and imaginary components thereof; and digital beam forming means operable to receive the real and imaginary components from said phase detection means to synthesize these real and imaginary components so as to form a multiplicity of beams.

21. An antenna system as defined in claim 20 further comprising switching means for correspondingly connecting said plurality of signal transmitting means to said plurality of element antennas at the time of transmission and correspondingly connecting said plurality of element antennas to said plurality of second photomodulation means at the time of reception.

22. An antenna system as defined in claim 21 wherein each of said plurality of signal transmitting means includes a photo-demodulator operable to receive the light signal from a corresponding one of said first optical fiber means to convert the received light signal to the analog electrical signal and phasing means for controlling the phase of the analog electrical signal to be supplied to a corresponding one of said element antennas, thereby allowing an antenna beam to be formed in a desired direction.

23. An antenna system as defined in claim 22 wherein each of said A/D conversion means includes a low-noise amplifier for amplifying the analogue electrical signal and an analogue-to-digital converter for converting the amplified analogue electrical signal to the digital electrical signal.

* * * * *